US010283249B2

(12) United States Patent
Deligianni et al.

(10) Patent No.: US 10,283,249 B2
(45) Date of Patent: May 7, 2019

(54) METHOD FOR FABRICATING A MAGNETIC MATERIAL STACK

(71) Applicant: International Business Machines Corporation, Armonk, NY (US)

(72) Inventors: Hariklia Deligianni, Alpine, NJ (US); Bruce B. Doris, Slingerlands, NY (US); Eugene J. O'Sullivan, Nyack, NY (US); Naigang Wang, Ossining, NY (US)

(73) Assignee: International Business Machines Corporation, Armonk, NY (US)

( * ) Notice: Subject to any disclaimer, the term of this patent is extended or adjusted under 35 U.S.C. 154(b) by 151 days.

(21) Appl. No.: 15/281,466

(22) Filed: Sep. 30, 2016

(65) Prior Publication Data

US 2018/0096771 A1 Apr. 5, 2018

(51) Int. Cl.

| | |
|---|---|
| ***H01F 7/06*** | (2006.01) |
| ***H01F 17/04*** | (2006.01) |
| ***H01F 41/34*** | (2006.01) |
| ***H01F 41/14*** | (2006.01) |

(52) U.S. Cl.
CPC ..... *H01F 17/04* (2013.01); *H01F 41/14* (2013.01); *H01F 41/34* (2013.01)

(58) Field of Classification Search
CPC .... H01F 17/04; H01F 17/0013; H01F 27/292; H01F 41/00
See application file for complete search history.

(56) References Cited

U.S. PATENT DOCUMENTS

| | | | |
|---|---|---|---|
| 4,640,871 | A | 2/1987 | Hayashi et al. |
| 5,032,945 | A | 7/1991 | Argyle et al. |
| 5,763,108 | A | 6/1998 | Chang et al. |
| 6,346,336 | B1 | 2/2002 | Nago |
| 6,441,715 | B1 | 8/2002 | Johnson |

(Continued)

FOREIGN PATENT DOCUMENTS

| | | | |
|---|---|---|---|
| CN | 104485325 | A | 4/2015 |
| JP | 0636934 | A | 6/1994 |

(Continued)

OTHER PUBLICATIONS

H. Namba et al., "On-Chip Vertically Coiled Solenoid Inductors and Transformers for RF SoC Using 90nm CMOS Interconnect Technology," IEEE Radio Frequency Integrated Circuits Symposium (RFIC), Jun. 2011, 4 pages.

(Continued)

*Primary Examiner* — Paul D Kim
(74) *Attorney, Agent, or Firm* — Vazken Alexanian; Ryan, Mason & Lewis, LLP

(57) ABSTRACT

A method for fabricating a magnetic material stack on a substrate includes the following steps. A first dielectric layer is formed. A first magnetic material layer is formed on the first dielectric layer. At least a second dielectric layer is formed on the first magnetic material layer. At least a second magnetic material layer is formed on the second dielectric layer. During one or more of the forming steps, a surface smoothing operation is performed to remove at least a portion of surface roughness on the layer being formed. The magnetic material stack can be used to form a low magnetic loss yoke inductor.

15 Claims, 12 Drawing Sheets

(56) References Cited

U.S. PATENT DOCUMENTS

| | | | | |
|---|---|---|---|---|
| 6,492,708 | B2 | 12/2002 | Acosta et al. | |
| 6,573,148 | B1 | 6/2003 | Bothra | |
| 6,650,220 | B2 | 11/2003 | Sia et al. | |
| 6,720,230 | B2 | 4/2004 | Acosta et al. | |
| 7,107,666 | B2 | 9/2006 | Hiatt et al. | |
| 7,463,131 | B1 | 12/2008 | Hwang et al. | |
| 7,719,084 | B2 | 5/2010 | Gardner et al. | |
| RE41,581 | E | 8/2010 | Davies | |
| 7,867,787 | B2 | 1/2011 | Gardner et al. | |
| 8,102,236 | B1 | 1/2012 | Fontana, Jr. et al. | |
| 8,717,136 | B2 | 5/2014 | Fontana, Jr. et al. | |
| 8,754,500 | B2 | 6/2014 | Webb | |
| 9,035,422 | B2 | 5/2015 | Khanolkar et al. | |
| 9,047,890 | B1 | 6/2015 | Herget | |
| 9,064,628 | B2 | 6/2015 | Fontana, Jr. et al. | |
| 9,383,418 | B2 * | 7/2016 | Mohan | G01R 33/04 |
| 9,697,948 | B2 | 7/2017 | Osada et al. | |
| 9,859,357 | B1 | 1/2018 | Deligianni et al. | |
| 2001/0050607 | A1 | 12/2001 | Gardner | |
| 2002/0114932 | A1 | 8/2002 | Yoshikawa et al. | |
| 2002/0130386 | A1 | 9/2002 | Acosta et al. | |
| 2003/0005572 | A1 * | 1/2003 | Gardner | H01F 17/0006 29/602.1 |
| 2003/0029520 | A1 | 2/2003 | Ingvarsson et al. | |
| 2003/0209295 | A1 | 11/2003 | Cooper et al. | |
| 2003/0213615 | A1 | 11/2003 | Utsurni et al. | |
| 2004/0244191 | A1 * | 12/2004 | Orr | H05K 3/4092 29/842 |
| 2005/0093437 | A1 | 5/2005 | Ouyang | |
| 2006/0091958 | A1 | 5/2006 | Bhatti et al. | |
| 2007/0030659 | A1 | 2/2007 | Suzuki et al. | |
| 2008/0003699 | A1 | 1/2008 | Gardner et al. | |
| 2009/0007418 | A1 * | 1/2009 | Edo | H01F 41/0246 29/609 |
| 2009/0219754 | A1 | 9/2009 | Fukumoto | |
| 2010/0000780 | A1 | 1/2010 | Zhu et al. | |
| 2010/0019332 | A1 | 1/2010 | Taylor | |
| 2010/0087066 | A1 | 4/2010 | O'Sullivan | |
| 2011/0175193 | A1 | 7/2011 | Nakagawa | |
| 2012/0299137 | A1 | 11/2012 | Worledge | |
| 2013/0106552 | A1 | 5/2013 | Fontana, Jr. et al. | |
| 2013/0224887 | A1 | 8/2013 | Lee et al. | |
| 2013/0314192 | A1 | 11/2013 | Fontana, Jr. et al. | |
| 2013/0316503 | A1 | 11/2013 | Doris et al. | |
| 2014/0021426 | A1 | 1/2014 | Lee et al. | |
| 2014/0061853 | A1 | 3/2014 | Webb | |
| 2014/0159850 | A1 | 6/2014 | Roy et al. | |
| 2014/0190003 | A1 | 7/2014 | Fontana, Jr. et al. | |
| 2014/0216939 | A1 | 8/2014 | Fontana, Jr. et al. | |
| 2014/0239443 | A1 | 8/2014 | Gallagher et al. | |
| 2014/0339653 | A1 | 11/2014 | Chang et al. | |
| 2015/0048918 | A1 | 2/2015 | Park et al. | |
| 2015/0097267 | A1 | 4/2015 | Tseng et al. | |
| 2015/0109088 | A1 | 4/2015 | Kim et al. | |
| 2015/0171157 | A1 | 6/2015 | Sturcken et al. | |
| 2015/0279545 | A1 | 10/2015 | Fazelpour et al. | |
| 2016/0005527 | A1 | 1/2016 | Park et al. | |
| 2016/0086721 | A1 | 3/2016 | Park et al. | |
| 2017/0256708 | A1 | 9/2017 | Towfick et al. | |
| 2018/0005740 | A1 | 1/2018 | Doris et al. | |
| 2018/0005741 | A1 | 1/2018 | Doris et al. | |
| 2018/0019295 | A1 | 1/2018 | Deligianni et al. | |
| 2018/0047805 | A1 | 2/2018 | Deligianni et al. | |

FOREIGN PATENT DOCUMENTS

| | | | | |
|---|---|---|---|---|
| JP | 2006178395 | A | 7/2006 | |
| JP | 5096278 | B2 | 4/2010 | |
| JP | 2010080774 | A | 4/2010 | |
| KR | 100998962 | B1 | 12/2010 | |
| WO | WO-0195619 | A2 * | 12/2001 | G02F 1/133553 |
| WO | 2018002736 | | 1/2018 | |

OTHER PUBLICATIONS

English translation for Korean Application No. KR100998962B1.

E.J. O'Sullivan et al., "Developments in Integrated On-Chip Inductors with Magnetic Yokes," The Electrochemical Society, Apr. 2012, Abstract #3407, 1 page.

K. Van Schuylenbergh et al., "On-Chip Out-of-Plane High-Q Inductors," IEEE Lester Eastman Conference on High Performance Devices at University of Delaware, Aug. 2002, pp. 364-373.

E.J. O'Sullivan et al., "Developments in Integrated On-Chip Inductors with Magnetic Yokes," ECS Transactions, Mar. 2013, pp. 93-105, vol. 50, No. 10.

Nimit Chomnawang, "Three-Dimensional Micromachined On-Chip Inductors for High Frequency Applications," A Dissertation, The Department of Electrical and Computer Engineering, Dec. 2002.

E.J. O'Sullivan et al., "New Developments in Magnetic Inductors for On-Chip Power Conversion, Including Fabrication," Prime, Oct. 2-7, 2016, 2 pages, Hawaii.

M.-Z. Yang et al., "Manufacture and Characterization of High Q-Factor Inductors Based on CMOS-MEMS Techniques," Sensors, Oct. 19, 2011, 9 pags.

M.-H. Chang, "A Study of On-Chip Solenoid Inductors for High Frequency Applications," 8th Biennial International Symposium on Communications (ISCOM), Nov. 2005, 4 pages.

* cited by examiner

100

100

100

100

100

100

100

100

200

200

200

200

200

300

300

300

300

METHOD FOR FABRICATING A MAGNETIC MATERIAL STACK

BACKGROUND

Inductors are known to be critical energy storage components of power conversion circuits located on integrated circuit chips. By way of one example, a thin-film ferromagnetic inductor may be used for on-chip DC-DC voltage conversion on a computer processor.

Such inductors have typically been formed by creating a magnetic material stack that is comprised of multiple layers of magnetic material. The magnetic material stack serves as the yoke material for the inductor, around which one or more coil windings or wires (e.g., single-turn and multi-turn coil designs) are wrapped. In the thin-film ferromagnetic inductor, the stack may be several microns or more in thickness. The overall thickness of the stack is selected to obtain a desired inductance value, while maintaining a desired operating frequency.

While increasing the thickness of the magnetic material stack increases the inductance value, it also increases eddy currents. An eddy current is an electrical current that is induced within a conductor by a changing magnetic field in the conductor. The induced electrical current creates a magnetic field that opposes the magnetic field that created the induced current, which adversely affects the performance of the inductor. Thus, controlling the thickness of the magnetic material stack is beneficial to the performance of the inductor. However, at micron-level stack sizes, such control is a significant challenge.

SUMMARY

Illustrative embodiments of the invention provide techniques for fabricating improved magnetic material stacks via surface roughness control. While such magnetic material stacks are well-suited for use in forming magnetic inductor structures (e.g., yoke inductors), they can alternatively be used in forming a variety of other electronic structures.

For example, in one embodiment, a method for fabricating a magnetic material stack on a substrate comprises the following steps. A first dielectric layer is formed. A first magnetic material layer is formed on the first dielectric layer. At least a second dielectric layer is formed on the first magnetic material layer. At least a second magnetic material layer is formed on the second dielectric layer. During one or more of the forming steps, a surface smoothing operation is performed to remove at least a portion of surface roughness on the layer being formed.

In another embodiment, a magnetic material stack comprises: a first dielectric layer; a first magnetic material layer on the first dielectric layer; at least a second dielectric layer on the first magnetic material layer; and at least a second magnetic material layer on the second dielectric layer. One or more surfaces of the formed layers are smoothed to remove at least a portion of surface roughness on the formed layer.

In yet another embodiment, a magnetic inductor structure comprises a substrate. A magnetic material stack is formed on the substrate. The magnetic material stack comprises: a first dielectric layer; a first magnetic material layer on the first dielectric layer; at least a second dielectric layer on the first magnetic material layer; and at least a second magnetic material layer on the second dielectric layer. One or more surfaces of the formed layers are smoothed to remove at least a portion of surface roughness on the formed layer. One or more conductive windings are positioned around the magnetic material stack.

Advantageously, illustrative embodiments improve the performance of magnetic inductor structures by controlling the surface roughness of one or more layers that form the magnetic material stack. More particularly, such surface roughness control techniques reduce magnetic loss and thereby improve inductor performance. Examples of such surface roughness control techniques comprise planarization and/or polishing.

Other embodiments will be described in the following detailed description of embodiments, which is to be read in conjunction with the accompanying figures.

DETAILED DESCRIPTION

Figure 1A:
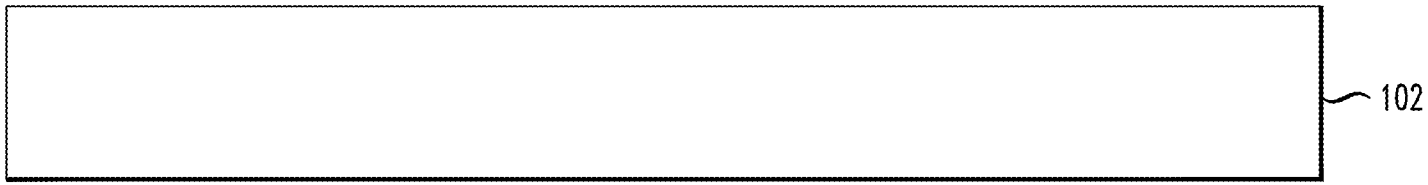
FIG. 1A is a schematic cross-sectional side view of a portion of a magnetic material stack at a first-intermediate fabrication stage, according to an embodiment of the invention.

Illustrative embodiments provide techniques for fabricating magnetic material stacks and magnetic inductor structures. More particularly, illustrative embodiments provide fabrication techniques that address problems with existing fabrication techniques such as, but not limited to, stack thickness control. Illustrative embodiments provide surface roughness control to minimize inductor performance problems such as magnetic loss. As mentioned above, magnetic loss is an important issue for magnetic material stacks in magnetic inductors. Illustrative embodiments realize that surface roughness can lead to damping loss which degrades overall inductor performance.

Surface roughness (or, more simply, roughness) is a component of surface texture, and is typically quantified by the deviations in the direction of the normal vector of a real surface from its ideal form. There are several ways to measure surface roughness according to American Society of Mechanical Engineers (ASME) standards.

One standard measure is known as Ra roughness. Ra roughness is the arithmetic average of the absolute values of the profile height deviations from the mean line, recorded within a given evaluation length. More simply, Ra is the average of a set of individual measurements of a surface's peaks and valleys. Another standard measure is known as Root Mean Square (RMS) roughness. RMS roughness is the root mean square average of the profile height deviations from the mean line, recorded within an evaluation length.

In an illustrative embodiment, a method is provided for forming improved magnetic material stacks for magnetic inductors by controlling surface roughness. RMS roughness for starting wafers for inductor fabrication just prior to magnetic material fabrication is about 0.5 nanometers (nm) in RMS roughness. Illustrative embodiments advantageously realize that a combination of a deposition process and a chemical mechanical planarization (CMP) process can be used to reduce the RMS roughness, e.g., to about 0.08 nm RMS roughness. The RMS roughness of a typical amorphous magnetic material such as cobalt-iron-boron (CoFeB) is about 0.23 nm in RMS roughness and the spacer dielectric material is about 0.2 nm in RMS roughness for low temperature silicon dioxide. Although the RMS roughness for roughness for Co-based magnetic materials (for example, CoZrTa, CoZr, CoZrNb, CoZrMo, FeCoAlN, CoP, FeCoP, CoPw, CoBW, CoHf, CoNb, CoW, CoTi, FeCoN, FeTaN, FeCoBSi, FeNi, CoZrO, CoFeHfO, CoFeAlO, and CoFe-$SiO_2$) and the dielectric spacer can be relatively smooth, the number of alternating film layers in the stack can be high, i.e., 20 or more, and the roughness of each layer is additive. Thus, after 10 or more layers, the RMS roughness can be about 2.0 nm or higher and can have a profound negative effect on the magnetic loss for the inductor. Illustrative embodiments provide techniques for controlling such surface roughness. Note that surface roughness quantities described below are illustratively measured in RMS roughness. However, Ra roughness or some other surface roughness measure can alternatively be used.

It is to be understood that embodiments discussed herein are not limited to the particular materials, features, and processing steps shown and described herein. In particular, with respect to fabrication (forming or processing) steps, it is to be emphasized that the descriptions provided herein are not intended to encompass all of the steps that may be used to form a functional integrated circuit device. Rather, certain steps that are commonly used in fabricating such devices are purposefully not described herein for economy of description.

Moreover, the same or similar reference numbers are used throughout the drawings to denote the same or similar features, elements, layers, regions, or structures, and thus, a detailed explanation of the same or similar features, elements, layers, regions, or structures will not be repeated for each of the drawings. It is to be understood that the terms "about," "approximately" or "substantially" as used herein with regard to thicknesses, widths, percentages, ranges, etc., are meant to denote being close or approximate to, but not exactly. For example, the term "about" or "substantially" as used herein implies that a small margin of error is present such as, by way of example only, 1% or less than the stated amount. Also, in the figures, the illustrated scale of one layer, structure, and/or region relative to another layer, structure, and/or region is not necessarily intended to represent actual scale.

FIGS. 1A through 1J illustrate a method for fabricating a magnetic material stack with reduced magnetic loss using surface roughness control. FIG. 1A depicts a substrate 102. For the purpose of clarity, several fabrication steps leading up to the fabrication stage shown in FIG. 1A are omitted. In other words, substrate 102 does not necessarily start out in the form illustrated in the schematic representation of FIG. 1A, but may develop into the illustrated structure over one or more well-known processing steps which are not illustrated but are well-known to those of ordinary skill in the art. For example, it is assumed that front-end-of-line (FEOL), middle-of-line (MOL) and back-end-of-line (BEOL) processing stages have been completed prior to the state of the substrate 102 in FIG. 1A.

Note that the same reference numeral (100) is used to denote the schematic illustrating the process through the various intermediate fabrication stages illustrated in FIGS. 1A-1J. Note also that the substrate 102 and subsequent layers formed thereon can also be considered to be comprised within a semiconductor structure, a semiconductor device, and/or an integrated circuit, or some part thereof.

As shown in FIG. 1A, the process of building the magnetic material stack for the magnetic inductors starts with substrate 102. Substrate 102 may be a processed wafer, meaning that FEOL, MOL, and BEOL processing has already been completed. A CMP process may be applied to the substrate 102 to reduce surface roughness. As will be illustrated and explained, the magnetic material stack to be formed on the surface of substrate 102 is comprised of alternating layers of magnetic material, such as, for example, Co-based magnetic materials, and dielectric spacers.

Figure 1B:
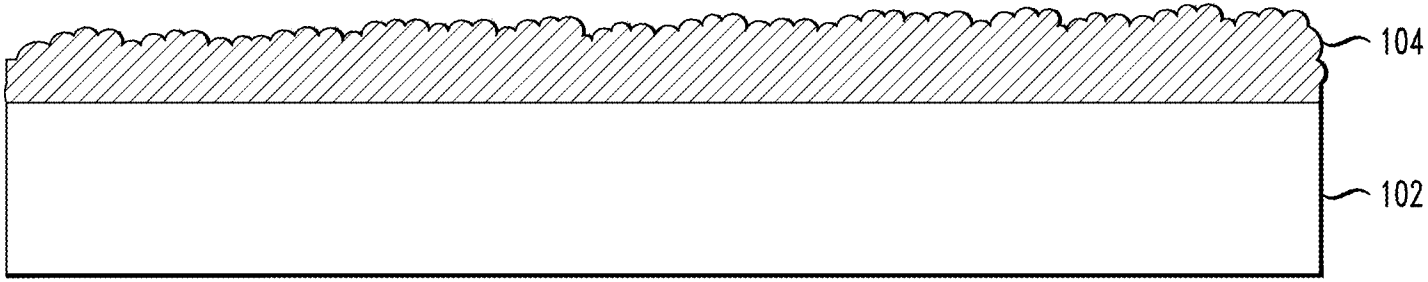
FIG. 1B is a schematic cross-sectional side view of a portion of a magnetic material stack at a second-intermediate fabrication stage, according to an embodiment of the invention.

Turning now to FIG. 1B, as shown, a first dielectric layer 104 is deposited over the surface of substrate 102. The dielectric layers in the magnetic material stack serve as spacers between the magnetic material layers. The dielectric material of the dielectric layer 104 may comprise, for example, silicon dioxide ($SiO_2$), silicon nitride (SiN), or magnesium oxide (MgO), although other dielectric materials may be used. Since the dielectric material is highly conformal, the initial roughness from the substrate 102 translates to the top surface of the deposited film. Additionally, the roughness of the deposited film itself is typically additive to the overall roughness. Typically, the first dielectric layer 104, which may be thicker than subsequent dielectric layers deposited in the stack, has a thickness from about 200 nm to about 2000 nm.

Figure 1C:
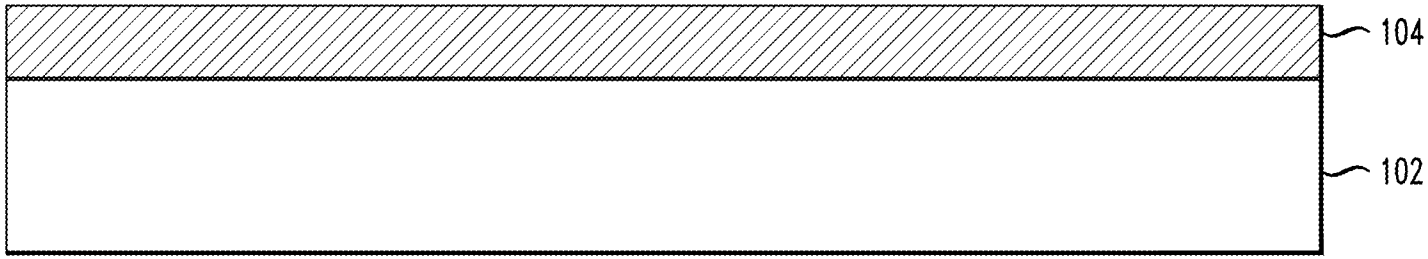
FIG. 1C is a schematic cross-sectional side view of a portion of a magnetic material stack at a third-intermediate fabrication stage, according to an embodiment of the invention.

Next, a process for reducing the roughness on the surface of the first dielectric layer 104 is performed, the result of which is illustrated in FIG. 1C. More particularly, a chemical mechanical planarization (CMP) process is performed on the first dielectric layer 104 to smooth the surface. CMP is a process of smoothing surfaces with the combination of chemical and mechanical forces. The process is effectively a hybrid process of chemical etching and free abrasive (mechanical) polishing. While CMP is used in this embodiment, it is to be appreciated that any suitable planarizing process and/or polishing process can be employed for smoothing the surface roughness of the dielectric layer 104.

Figure 1D:
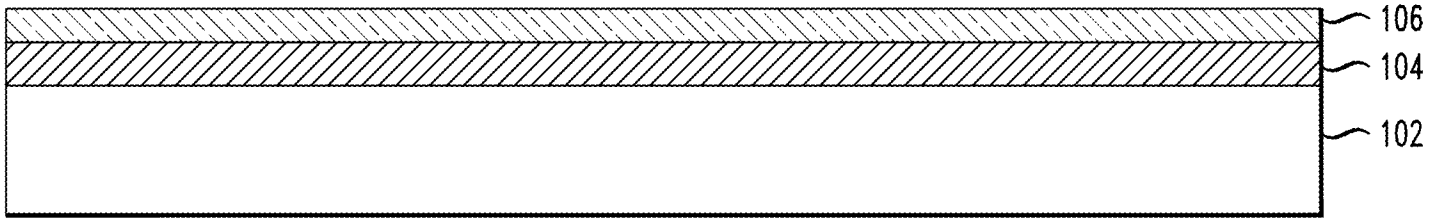
FIG. 1D is a schematic cross-sectional side view of a portion of a magnetic material stack at a fourth-intermediate fabrication stage, according to an embodiment of the invention.

Following the CMP process depicted in FIG. 1C, a first magnetic material layer 106, such as, for example, Co-based magnetic materials, is deposited on the smoothed surface of the first dielectric layer 104 as illustrated in FIG. 1D. In one embodiment, the magnetic material 106 has a film thickness of about 100 nm to 200 nm.

Figure 1E:
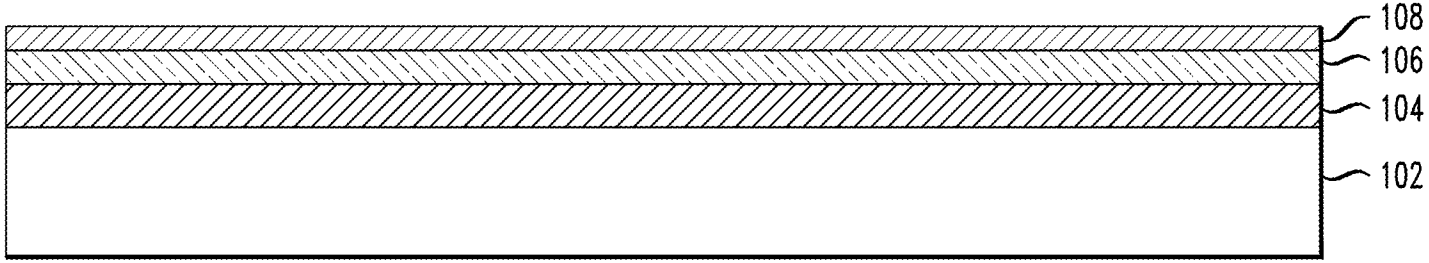
FIG. 1E is a schematic cross-sectional side view of a portion of a magnetic material stack at a fifth-intermediate fabrication stage, according to an embodiment of the invention.

As illustrated in FIG. 1E, a second dielectric layer 108 is deposited on the surface of the first magnetic material layer 106. The second dielectric layer 108 may be comprised of material such as, for example, $SiO_2$, SiN, or MgO, and have a thickness of about 5 nm to 500 nm. As with the first dielectric layer 104, a CMP process is performed on the second dielectric layer 108 to smooth the surface. Note that FIG. 1E does not illustrate the rough surface of the second dielectric layer 108 after deposit and prior to the CMP process, but rather illustrates the second dielectric layer 108 after CMP has been performed.

Figure 1F:
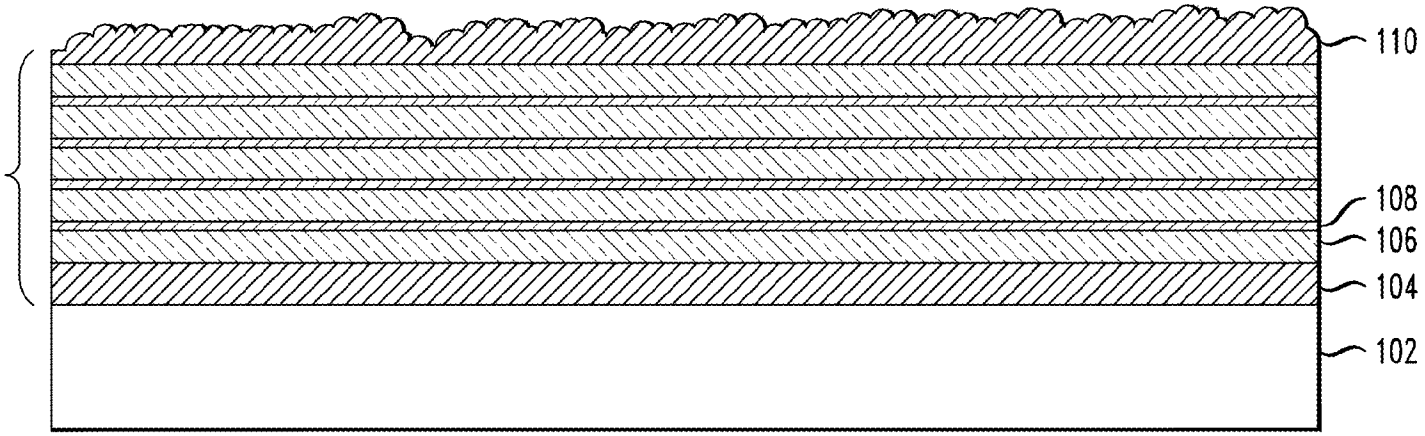
FIG. 1F is a schematic cross-sectional side view of a portion of a magnetic material stack at a sixth-intermediate fabrication stage, according to an embodiment of the invention.

Turning now to FIG. 1F, a plurality of alternating magnetic material layers and dielectric layers are deposited on the substrate 102 forming magnetic material stack 112, along with the previously deposited magnetic material layer (106) and dielectric layers (104 and 108). Each additional magnetic material layer is deposited as explained above in the context of FIG. 1D, while each additional dielectric layer is deposited as explained above in the context of FIG. 1E. It is to be appreciated that the dielectric layers are processed via CMP after deposition as explained above to smooth their surface roughness. However, it is also to be understood that removal of accumulating surface roughness of the overall magnetic material stack is still achieved when less than all of the dielectric layers are subjected to CMP. Accordingly, while a magnetic material stack is created by alternating depositions of magnetic material layers and dielectric layers, one or more illustrative embodiments provide for periodically applying CMP to smooth the surface roughness of the stack. In other words, CMP can be applied after multiple (two or more) magnetic material layer/dielectric layer sets have been deposited. Alternatively, CMP can be applied after each magnetic material layer/dielectric layer set is deposited.

Thus, after several layers of deposition and despite performing CMP on one or more of the dielectric layers, the roughness from each layer of magnetic material and dielectric material adds up, as illustrated in FIG. 1F by top dielectric layer 110 (note that top dielectric layer 110 is considered part of the magnetic material stack 112, and the top dielectric layer 110 may have a thickness of about 200 nm to about 2000 nm), and the surface of top dielectric layer 110 is in need of planarization/polishing. For example, if the surface roughness of the Co-based magnetic material layer is around 0.2 nm and the surface roughness of the dielectric layer is about 0.2 nm, then after about 10 layers, the roughness may be around 2.0 nm and can have a negative affect and lead to magnetic loss in the form of damping.

Figure 1G:
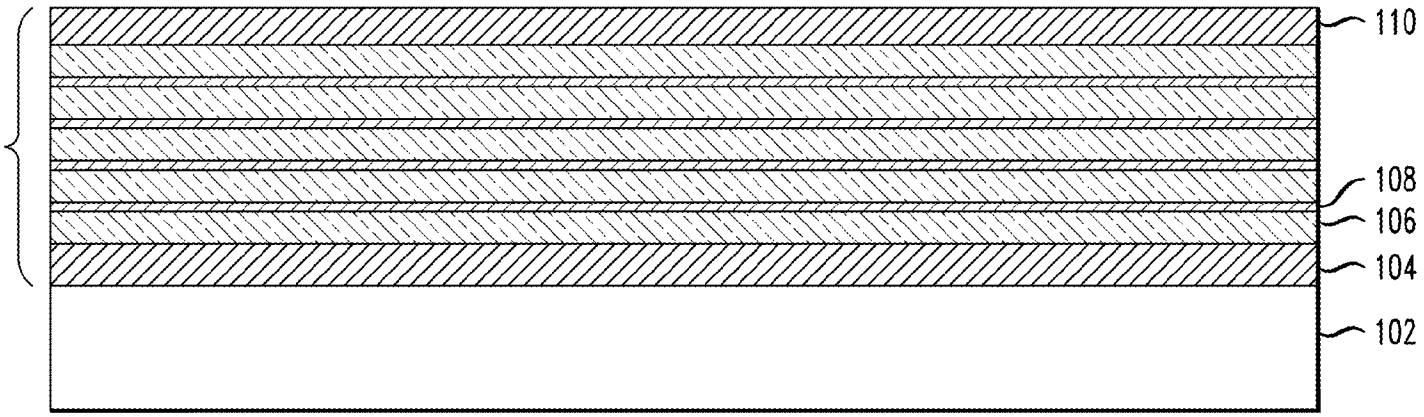
FIG. 1G is a schematic cross-sectional side view of a portion of a magnetic material stack at a seventh-intermediate fabrication stage, according to an embodiment of the invention.

FIG. 1G illustrates the magnetic material stack 112 after CMP of top dielectric layer 110. For relatively thick magnetic material stacks, as mentioned above, the planarization/polishing process may be performed periodically, such as for example, after five layers of dielectric layers and magnetic material layers have been deposited. CMP may be performed more or less often depending on the extent of the expected material roughness of each of the dielectric and magnetic materials. Advantageously, thick yoke inductors having low loss can be made by employing the above described planarization/polishing techniques.

Figure 1H:
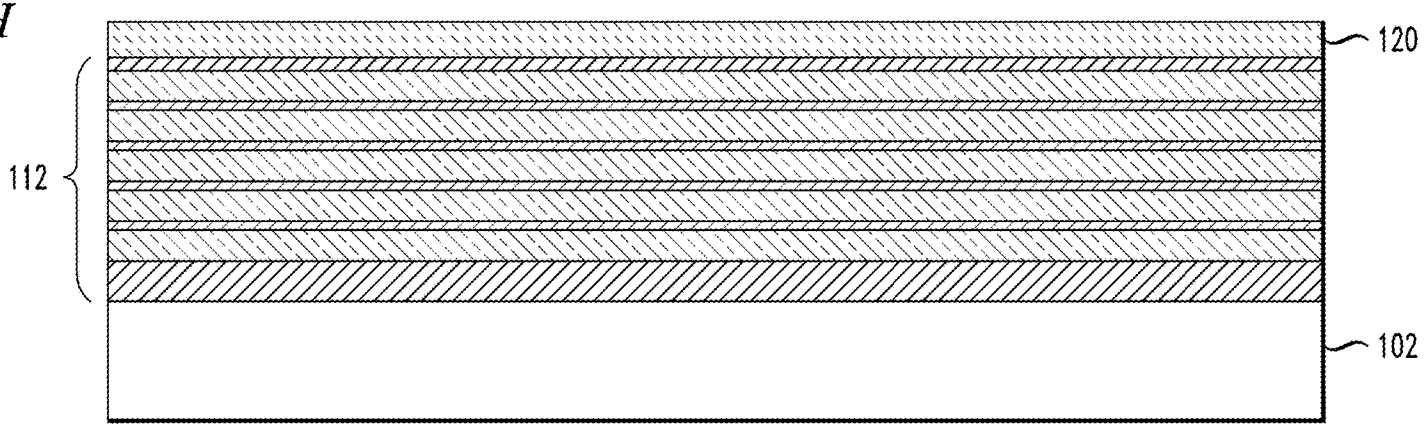
FIG. 1H is a schematic cross-sectional side view of a portion of a magnetic material stack at an eighth-intermediate fabrication stage, according to an embodiment of the invention.

Thick yoke inductors can be formed comprising the low loss thick magnetic material stack 112. In an illustrative embodiment, a plurality of inductors can be formed from the thick magnetic material stack 112 shown in FIG. 1H. The method includes first depositing a hard mask 120 over the top dielectric layer 110 of magnetic material stack 112, as illustrated in FIG. 1H. The hard mask 120 can include an oxide, a nitride, an oxynitride, or any multilayered combination thereof. The hard mask is formed utilizing a conventional deposition process including, for example, chemical vapor deposition (CVD), plasma enhanced chemical vapor deposition (PECVD), chemical solution deposition, evaporation, and physical vapor deposition (PVD). Alternatively, the hard mask may be formed by one of thermal oxidation, and thermal nitridation. The thickness of the hard mask employed may vary depending on the material of the hard mask itself as well as the techniques used in forming the same. Typically, the hard mask has a thickness from about 5 nm to about 100 nm.

Figure 1I:
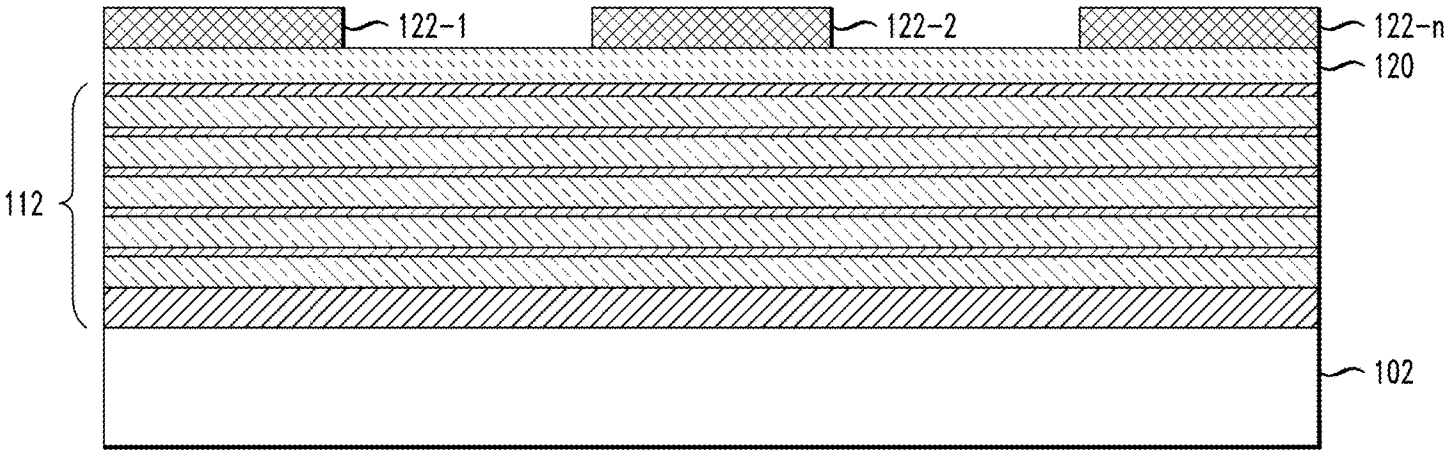
FIG. 1I is a schematic cross-sectional side view of a portion of a magnetic material stack at a ninth-intermediate fabrication stage, according to an embodiment of the invention.
Figure 1J:
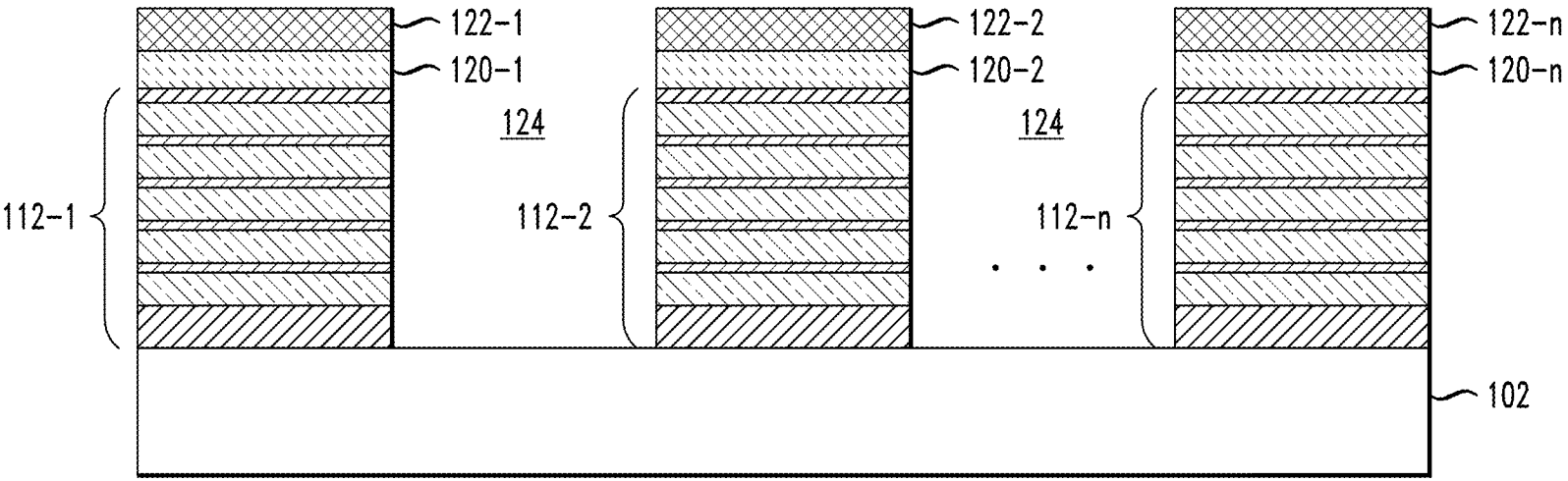
FIG. 1J is a schematic cross-sectional side view of a portion of a magnetic material stack at a tenth-intermediate fabrication stage, according to an embodiment of the invention.

FIG. 1I illustrates performing a lithography process forming a set of resist images 122-1, 122-2 . . . **122-*n* on the surface of hard mask 120. An etching process is then performed resulting in multiple thick magnetic material stacks 112-1, 112-2 . . . 112-*n*, as illustrated in FIG. 1J, formed between etch openings 124**. The etching process may include a dry etching process (such as, for example, reactive ion etching, ion beam etching, plasma etching or laser ablation), and/or a wet chemical etching process.

As shown, the magnetic material stack 112 (and hard mask 120) is removed in all locations that are not below one of the set of resist images 122-1, 122-2 . . . **122-*n*. As such, multiple magnetic material stacks 112-1, 112-2 . . . 112-*n* are formed, respectively, below resist image 122-1 and hard mask 120-1, below resist image 122-2 and hard mask 120-2, and below resist image 122-*n* and hard mask 120-*n*. The stacks may be used as part of some other electronic structures, such as independent low loss inductors, as will be further illustrated in FIGS. 2A through 2**E.

FIGS. 2A through 2E illustrate a method for fabricating a magnetic inductor structure with reduced magnetic loss using surface roughness control. Note that the same reference numeral (200) is used to denote the schematic illustrating the process through the various intermediate fabrication stages illustrated in FIGS. 2A-2E. Note also that the substrate and subsequent layers formed thereon can also be considered to be comprised within a semiconductor structure, a semiconductor device, and/or an integrated circuit, or some part thereof.

Figure 2A:
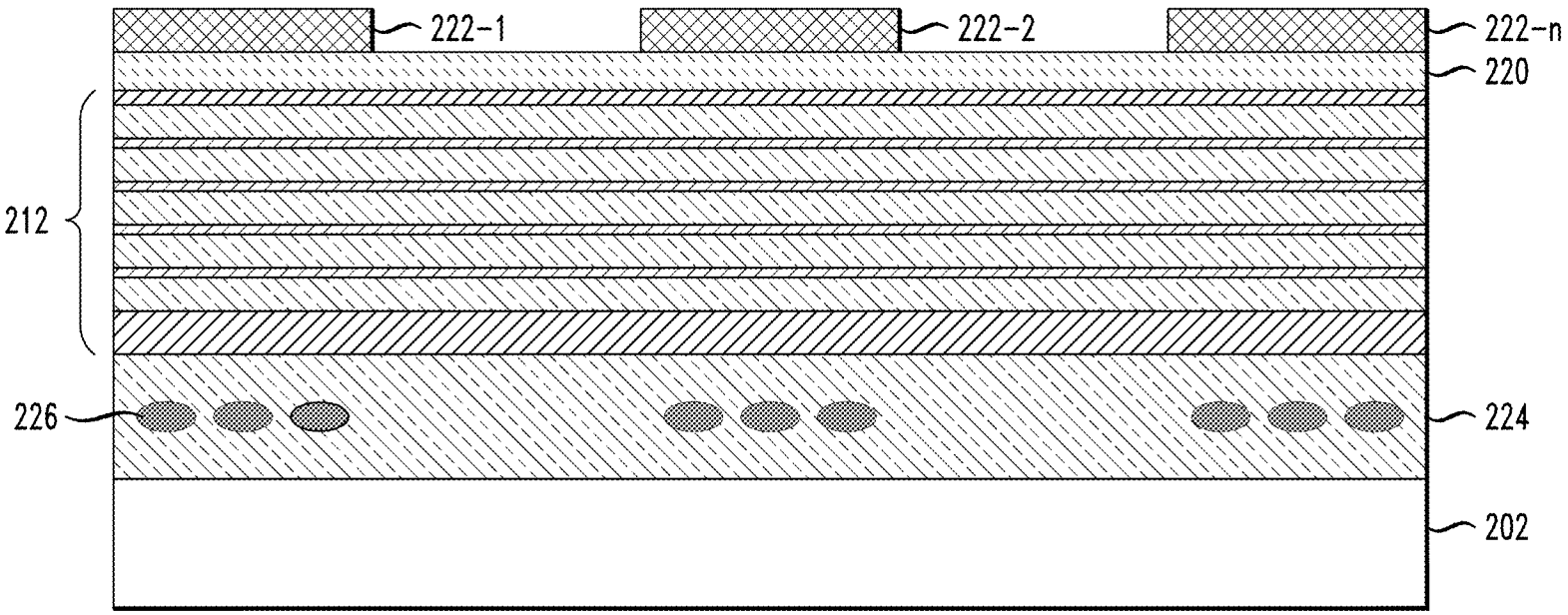
FIG. 2A is a schematic cross-sectional side view of a portion of a magnetic inductor structure at a first-intermediate fabrication stage, according to an embodiment of the invention.

FIG. 2A starts with a structure similar to the structure shown in FIG. 1I. That is, layers shown in FIG. 2A that are formed similarly to layers in FIG. 1I have reference numerals incremented by 100. Thus, substrate 202 is formed similarly to substrate 102, magnetic material stack 212 is formed similarly to magnetic material stack 112, hard mask 220 is formed similarly to hard mask 120, and resist images 222-1, 222-2 . . . **222-*n* are formed similarly to resist images 122-1, 122-2 . . . 122-*n***.

One distinction between the structure in FIG. 2A and the structure in FIG. 1I is that in FIG. 2A, it is assumed that prior to forming the thick magnetic material stack 212, portions of conductive inductor windings 226 are formed in a dielectric layer 224 on the surface of the substrate 202. While dielectric layer 224 is shown as a separate layer with respect to substrate 202, it is to be appreciated that layer 224 and windings 226 can be formed as part of substrate 202.

Figure 2B:
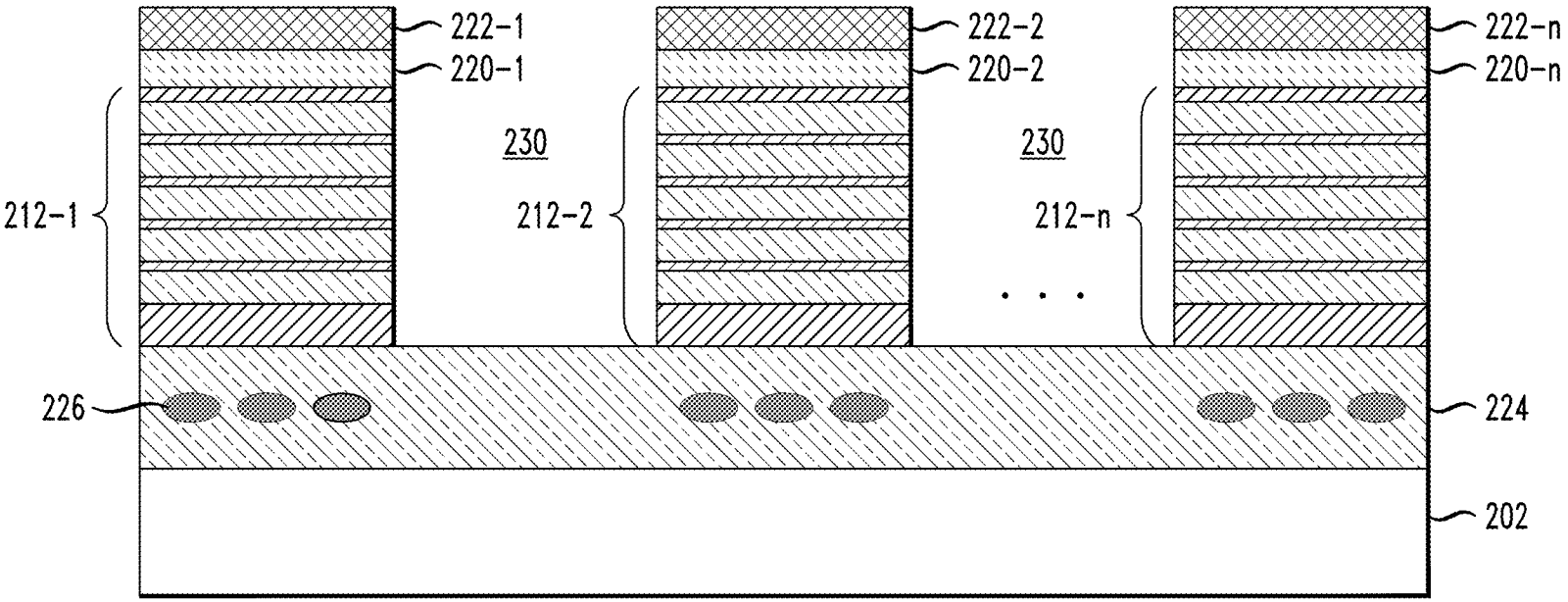
FIG. 2B is a schematic cross-sectional side view of a portion of a magnetic inductor structure at a second-intermediate fabrication stage, according to an embodiment of the invention.

FIG. 2B illustrates forming a plurality of thick magnetic material stacks 212-1, 212-2 . . . **212-*n* as described above in connection with FIG. 1J. Following the etching process, the separate stacks 212-1, 212-2 . . . 212-*n* are formed below respective resist images and hard mask portions (222-1 and 220-1, 222-2 and 220-2, and 222-*n* and 220-*n*) between etch openings 230. Note that each stack has a set of windings 226** positioned below each stack.

Figure 2C:
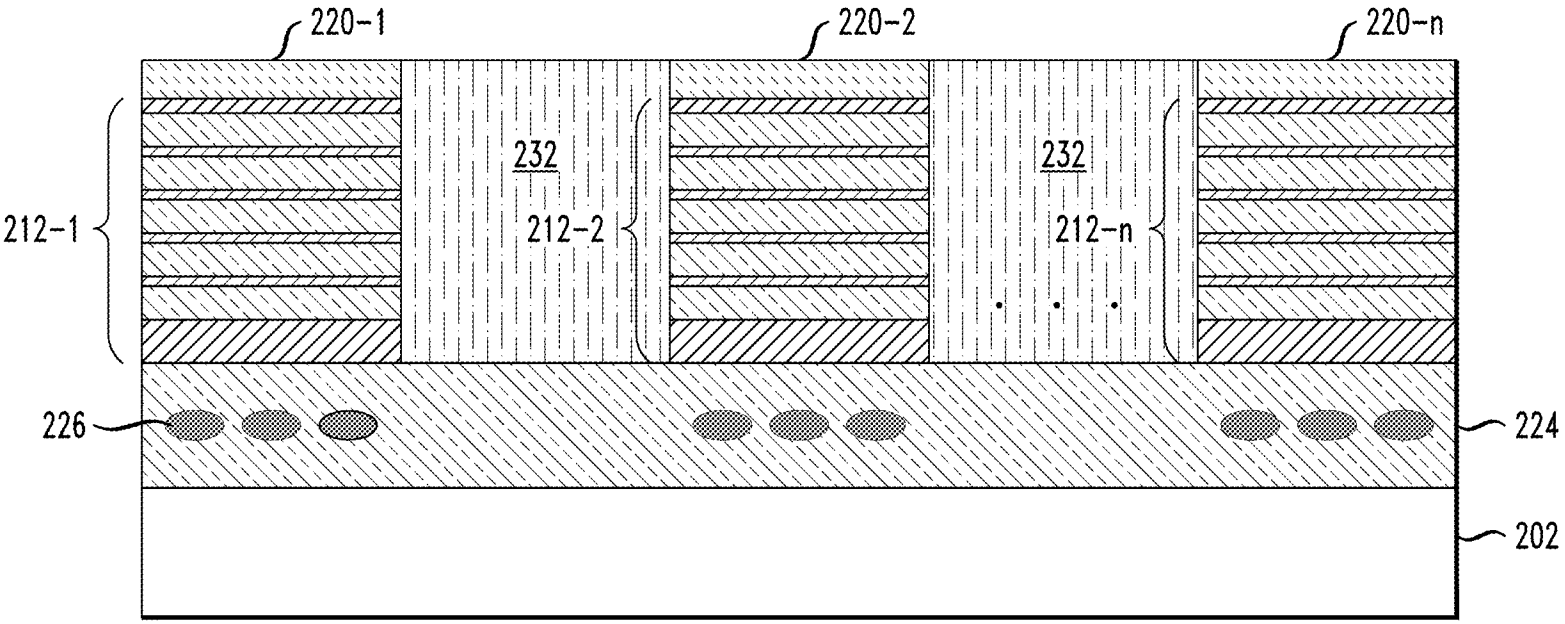
FIG. 2C is a schematic cross-sectional side view of a portion of a magnetic inductor structure at a third-intermediate fabrication stage, according to an embodiment of the invention.

In FIG. 2C, each etch opening 230 is filled with a dielectric material such as, for example, an interlayer dielectric (ILD) 232. In one illustrative embodiment, ILD 232 is Sift deposited by, for example, CVD, atomic layer deposition (ALD), PECVD, a spin on process, etc. A CMP process is then performed to remove the ILD material that is outside the etch openings 230, and to remove the resist images 221-1, 222-2 . . . **222-*n***.

Figure 2D:
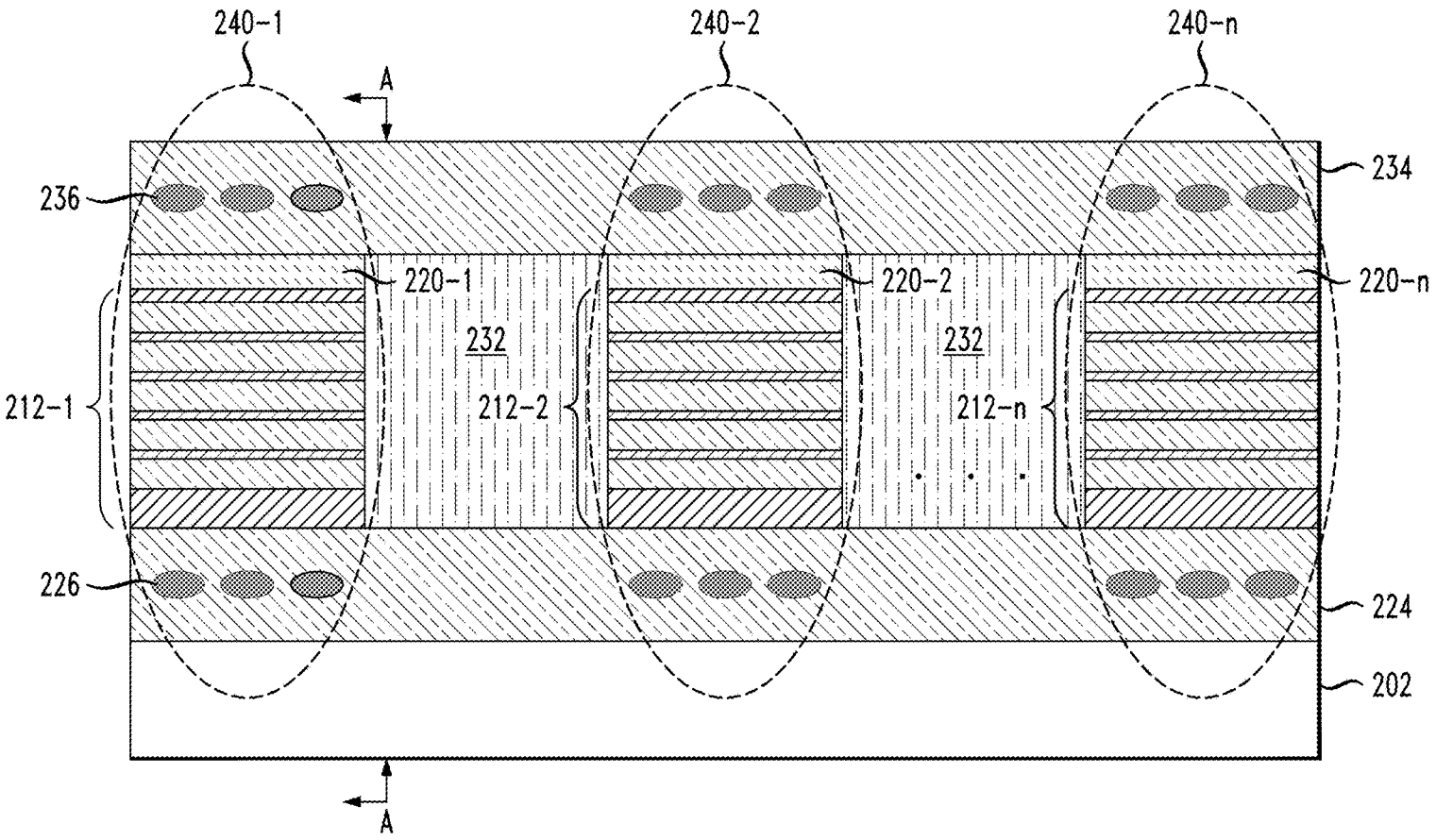
FIG. 2D is a schematic cross-sectional side view of a portion of a magnetic inductor structure at a fourth-intermediate fabrication stage, according to an embodiment of the invention.

A top layer of inductor windings 236, illustrated in FIG. 2D, is then formed in dielectric 234 above the thick magnetic material stacks 212-1, 212-2 . . . **212-*n*. Using standard processing techniques, the top inductor windings 236 and bottom inductor windings 226 are coupled to form a continuous inductor winding formed around each of the thick magnetic material stacks forming thick yolk inductors 240-1, 240-2 . . . 240-*n***.

Figure 2E:
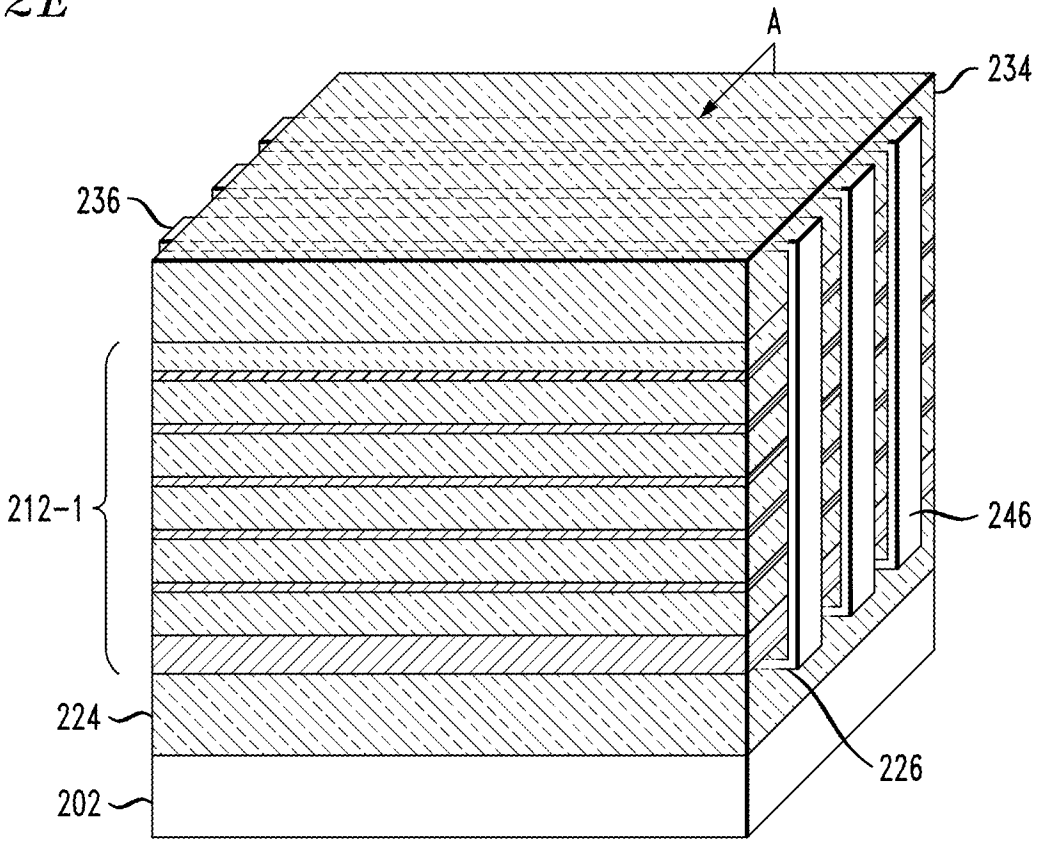
FIG. 2E illustrates a schematic perspective view of a portion of the magnetic inductor structure of FIG. 2D defined by line A-A.

A perspective view taken along line A-A in FIG. 2D is shown in FIG. 2E. The view in FIG. 2E illustrates portions of inductor windings 246 which couple top portions of the inductor windings 236 with the bottom portions of the inductor windings 226 around thick magnetic material stack 212-1. Each stack may have similarly coupled windings. However, it is to be understood that windings 226 and 236 may be coupled in other configurations depending on the desired configuration of the yoke inductor. It is to be further understood that while only three windings are shown for each stack, yoke inductor with more or less windings can be formed in alternative embodiments.

In an alternative embodiment, one or more of the dielectric layers of the magnetic material stack 112 (e.g., 104, 108, 110, etc.) or 212 can, itself, be formed as a multi-layer structure. In one example, the multi-layer structure is a bi-layer structure comprised of a first dielectric sub layer and a second dielectric sub layer. Thus, one or more of the dielectric layers (films) that separate the magnetic material layers in the magnetic material stack can have a bi-layer formation. In one illustrative embodiment, each of the dielectric layers in the stack is formed as a bi-layer dielectric structure as described herein. The formation of such a bi-layer dielectric structure is illustrated in FIGS. 3A through 3D.

It is to be understood that the processing steps shown in FIGS. 3A-3D, in conjunction with reference numeral 300, are similar to the processing steps of FIGS. 1B-1D with the exception of the additional processing steps associated with forming each of the dielectric layers as a bi-layer structure. Thus, a description of similar processing steps will not be repeated here.

Figure 3A:
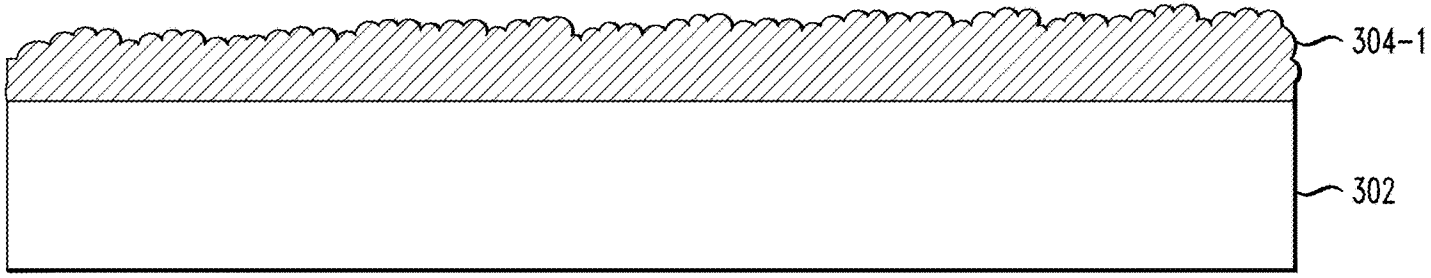
FIG. 3A is a schematic cross-sectional side view of a portion of a magnetic material stack at a first-intermediate fabrication stage, according to an embodiment of the invention.
Figure 3B:
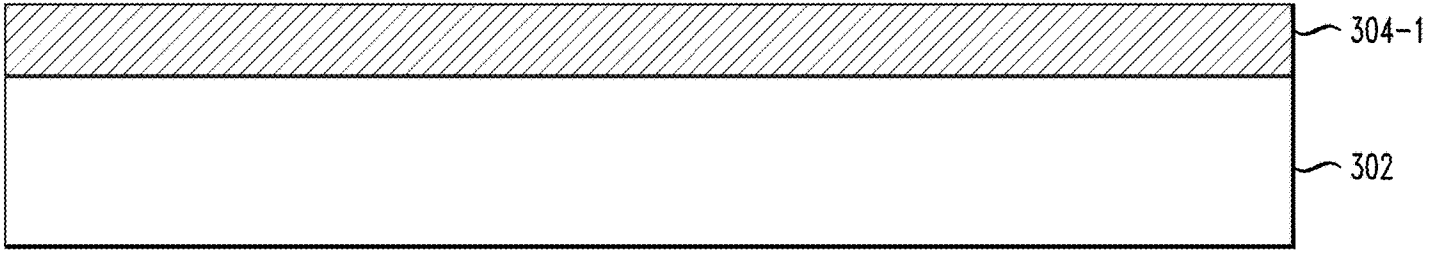
FIG. 3B is a schematic cross-sectional side view of a portion of a magnetic material stack at a second-intermediate fabrication stage, according to an embodiment of the invention.
Figure 3C:
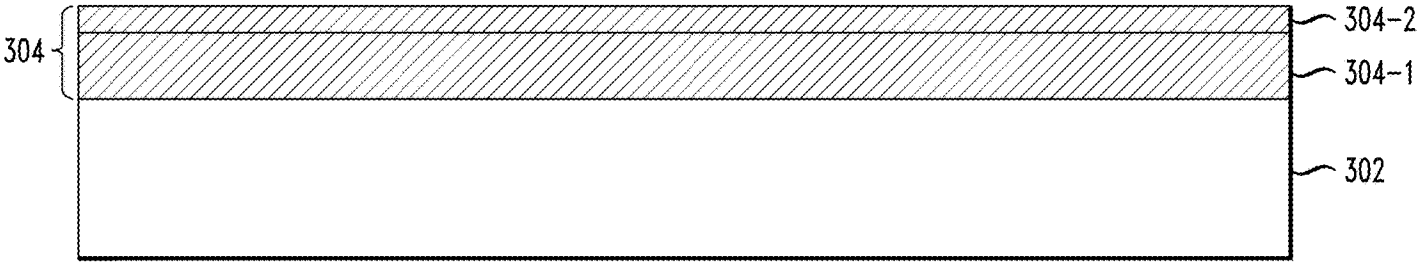
FIG. 3C is a schematic cross-sectional side view of a portion of a magnetic material stack at a third-intermediate fabrication stage, according to an embodiment of the invention.

As shown in FIG. 3A, a dielectric sub layer 304-1 is formed on a substrate 302 (similar to the formation of dielectric layer 104 on substrate 102). Next, a process for reducing the roughness on the surface of the dielectric sub layer 304-1 is performed, the result of which is illustrated in FIG. 3B. More particularly, a CMP process is performed on the dielectric sub layer 304-1 to smooth the surface.

Illustrative embodiments realize that the surface of the dielectric material (e.g., $SiO_2$, SiN, etc.) of layer 304-1 may become so smooth after CMP that magnetic material deposited thereon does not adhere as well as desired to form to the magnetic material stack. This is because it is realized herein that magnetic material, such as, for example, a cobalt-based magnetic material, may not always adequately adhere to extremely smooth oxide or nitride surfaces. Thus, in FIG. 3C, a dielectric sub layer 304-2 is formed on the smoothed dielectric sub layer 304-1. It is to be appreciated that the dielectric sub layer 304-2 is preferably thinner than dielectric sub layer 304-1 and can be a similar or dissimilar composition. This second dielectric sub layer 304-2 is not planarized and/or polished, thus maintaining some acceptable degree of surface roughness so as to improve adhesion of magnetic material deposited to the dielectric material.

It is to be appreciated that, in one illustrative embodiment, the bottom dielectric sub layer 304-1 is about 10 nm to about 100 nm prior to the smoothing operation, the smoothing operation only removes the surface roughness and the bulk material is not removed during the process. The surface roughness after the smoothing operation is less than 0.1 nm in RMS roughness, then the second (top) dielectric sub layer 304-2 can be about 3 nm to about 10 nm in thickness. In one illustrative embodiment, acceptable roughness is about 0.2 nm in RMS roughness or less, while about 0.8 nm in RMS roughness or higher is unacceptable.

Figure 3D:
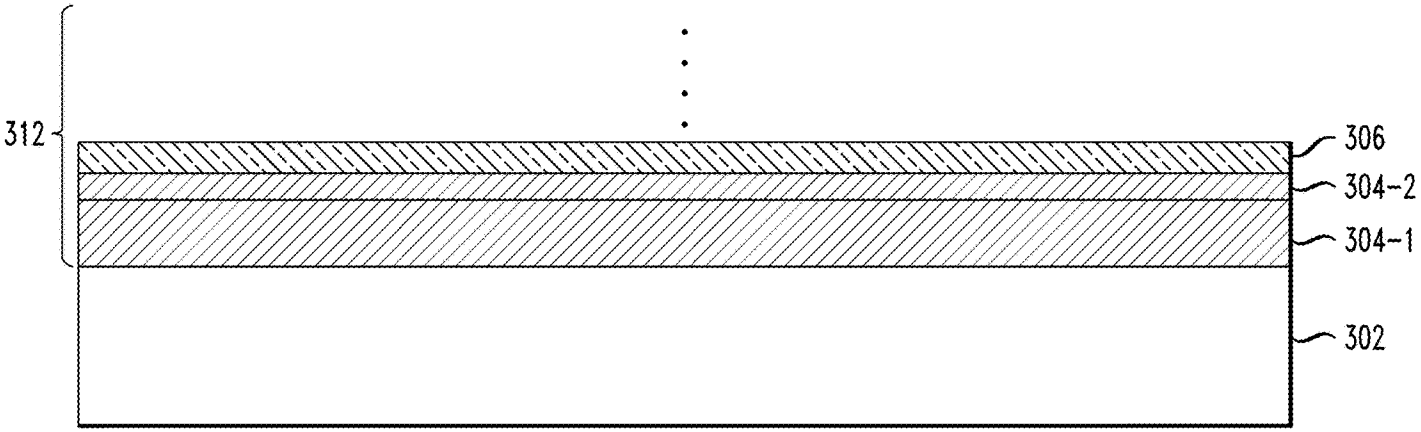
FIG. 3D is a schematic cross-sectional side view of a portion of a magnetic material stack at a fourth-intermediate fabrication stage, according to an embodiment of the invention.

Note that the two sub layers 304-1 and 304-2 comprise a dielectric layer 304. Then, as shown in FIG. 3D, magnetic material layer 306 (similar to 106) is formed on the dielectric layer 304. A completed magnetic material stack 312 is created above layer 306 similar to stacks 112 and 212, but where each of the additional dielectric layers are formed with the a bi-layer structure formation as described above for dielectric layer 304. In other embodiments, less than all of the dielectric layers in the stack 312 have the bi-layer structure.

It is to be understood that the methods discussed herein for fabricating semiconductor structures can be incorporated within semiconductor processing flows for fabricating other types of semiconductor devices and integrated circuits with various analog and digital circuitry or mixed-signal circuitry. In particular, integrated circuit dies can be fabricated with various devices such as transistors, diodes, capacitors, inductors, etc. An integrated circuit in accordance with embodiments can be employed in applications, hardware, and/or electronic systems. Suitable hardware and systems for implementing the invention may include, but are not limited to, personal computers, communication networks, electronic commerce systems, portable communications devices (e.g., cell phones), solid-state media storage devices, functional circuitry, etc. Systems and hardware incorporating such integrated circuits are considered part of the embodiments described herein.

Furthermore, various layers, regions, and/or structures described above may be implemented in integrated circuits (chips). The resulting integrated circuit chips can be distributed by the fabricator in raw wafer form (that is, as a single wafer that has multiple unpackaged chips), as a bare die, or in a packaged form. In the latter case, the chip is mounted in a single chip package (such as a plastic carrier, with leads that are affixed to a motherboard or other higher level carrier) or in a multichip package (such as a ceramic carrier that has either or both surface interconnections or buried interconnections). In any case, the chip is then integrated with other chips, discrete circuit elements, and/or other signal processing devices as part of either (a) an intermediate product, such as a motherboard, or (b) an end product. The end product can be any product that includes integrated circuit chips, ranging from toys and other low-end applications to advanced computer products having a display, a keyboard or other input device, and a central processor.

Although illustrative embodiments have been described herein with reference to the accompanying drawings, it is to be understood that the invention is not limited to those precise embodiments, and that various other changes and modifications may be made by one skilled in the art without departing from the scope or spirit of the invention.

What is claimed is:

1. A method, comprising:

providing a substrate;

forming a first dielectric layer on the substrate;

forming a first magnetic material layer on the first dielectric layer;

forming at least a second dielectric layer on the first magnetic material layer;

forming at least a second magnetic material layer on the second dielectric layer, wherein, during one or more of the forming steps, a surface smoothing operation is performed to remove at least a portion of surface roughness on at least one of the first dielectric layer and the second dielectric layer;

wherein the first dielectric layer, the first magnetic material layer, the second dielectric layer, and the second magnetic material layer define a magnetic material stack on the substrate, forming a hard mask on the magnetic material stack;

forming a set of resist images on the hard mask; and removing portions of the hard mask and the magnetic material stack between the set of resist images to form multiple magnetic material stack sections, adjacent magnetic material stack sections being separated by a spacing therebetween.

2. The method of claim 1, wherein the surface smoothing operation comprises a planarization process.

3. The method of claim 1, wherein the surface smoothing operation comprises a polishing process.

4. The method of claim 1, wherein the surface smoothing operation comprises a chemical mechanical planarization process.

5. The method of claim 1, wherein the first and second dielectric layers serve as spacers for the first and second magnetic material layers.

6. The method of claim 1, wherein the first and second dielectric layers are formed from a dielectric material selected from a group consisting of: silicon dioxide, silicon nitride, magnesium oxide, or combinations thereof.

7. The method of claim 1, wherein the first and second magnetic material layers are formed from an amorphous magnetic material.

8. The method of claim 7, wherein the amorphous magnetic material comprises a cobalt-based magnetic material.

9. The method of claim 1, further comprising:

forming one or more conductive windings around the magnetic material stack.

10. The method of claim 9, wherein the one or more conductive windings around the magnetic material stack form a magnetic inductor structure.

11. The method of claim 1, wherein the substrate comprises a processed wafer.

12. The method of claim 1, wherein at least one of the first dielectric layer and the second dielectric layer is comprised of a multi-layer structure, and the multi-layer structure is comprised of a first dielectric sub layer and a second dielectric sub layer.

13. The method of claim 12, wherein the surface smoothing operation is performed on the first dielectric sub layer, and the second dielectric sub layer is formed on the smoothed first dielectric sub layer.

14. The method of claim 1, wherein the first dielectric layer has a first dielectric thickness and the second dielectric layer has a second dielectric thickness less than the first dielectric thickness.

15. The method of claim 1, wherein an interlayer dielectric is filled within the spacing disposed between the adjacent magnetic multiple stack sections.

* * * * *